US006618995B2

(12) United States Patent
De Marco

(10) Patent No.: US 6,618,995 B2
(45) Date of Patent: Sep. 16, 2003

(54) CORROSION RESISTANT WINDOW CLOSURE MEMBER INCORPORATING A CLOSURE MEMBER FORMED FROM FOLDED SHEET METAL

(76) Inventor: Giuseppe De Marco, 185 Trowers Rd., Units 7 & 8, Woodbridge, Ontario (CA), L4L 5Z5

( * ) Notice: Subject to any disclaimer, the term of this patent is extended or adjusted under 35 U.S.C. 154(b) by 0 days.

(21) Appl. No.: 09/826,920

(22) Filed: Apr. 6, 2001

(65) Prior Publication Data

US 2002/0144464 A1 Oct. 10, 2002

(51) Int. Cl.[7] ..... E05D 15/30
(52) U.S. Cl. ..... 49/248; 49/345
(58) Field of Search ..... 49/246, 248, 250, 49/251, 339, 345, 346; 16/365, 366; 29/11; 72/379.2

(56) References Cited

U.S. PATENT DOCUMENTS

| | | | | | |
|---|---|---|---|---|---|
| 487,939 | A | * | 12/1892 | Smith | 29/11 |
| 1,475,967 | A | * | 12/1923 | Robertson | 16/365 |
| 1,614,166 | A | * | 1/1927 | Whitney | 16/337 |
| 1,749,913 | A | * | 3/1930 | Groehn | 72/379.2 |
| 1,772,560 | A | * | 8/1930 | Soss | 16/250 |
| 2,112,312 | A | * | 3/1938 | Smith | 16/387 |
| 2,194,902 | A | * | 3/1940 | Heuer | 72/333 |
| 2,977,810 | A | * | 4/1961 | Stavenau | 74/96 |
| 3,415,754 | A | * | 12/1968 | Frevel | 134/41 |
| 5,079,815 | A | * | 1/1992 | Carroll | 29/896.6 |
| 5,152,102 | A | | 10/1992 | La See | |
| 5,898,977 | A | * | 5/1999 | Muir | 16/363 |
| 5,920,959 | A | | 7/1999 | De Marco | |
| 5,964,011 | A | | 10/1999 | Ruston et al. | |
| 6,109,668 | A | | 8/2000 | Demarco | |
| 6,283,535 | B1 | * | 9/2001 | Yuge | 296/146.8 |

* cited by examiner

*Primary Examiner*—Gregory J. Strimbu

(57) ABSTRACT

A window closure system comprising a closure member for connecting a window sash to a window frame. The closure member comprises a corrosion resistant elongated rigid rectangular body portion formed from a single continuous stainless steel sheet or a single continuous stainless steel alloy sheet. The body portion having a planar layer and two metal members folded over into substantial abutting contact with the planar layer. One or more keeper members are used to engage the metal layers and prevent their movement from away from the abutting contact with the planar layer. The closure member may comprise part of a swivel arm, a hinge arm and a tie bar.

13 Claims, 4 Drawing Sheets

CORROSION RESISTANT WINDOW CLOSURE MEMBER INCORPORATING A CLOSURE MEMBER FORMED FROM FOLDED SHEET METAL

SCOPE OF THE INVENTION

The present invention relates to a window closure system for swingably attaching and locking a casement window to a window frame, and more particularly a corrosion resistant window closure system for use in marine, coastal and other high humidity environments where increased susceptibility to corrosion occurs.

BACKGROUND OF THE INVENTION

Various window hardware systems have been proposed to swingably attach and secure casement windows to a window frame. For example, residential casement windows are typically swingably attached to the window frame by a hinge assembly which is operable by means of a hand crank, and which further includes a hinge arm coupled along the window frame and an elongated L or U-shaped track coupled along a horizontal lower edge of the window sash. The hinge arm is pivotally movable with the window sash, with its other end slidable along the track. A swivel arm is pivotally joined at each of its ends to the track and a mid point of the hinge arm to assist in the outward and inward movement of the hinge arm.

The window may be locked or unlocked by the reciprocal movement of an elongated tie bar which is slidably mounted along one side of the window frame. The tie bar carries one or more bosses or projections which are moved into or out of engagement with ramped caming members mounted on an adjacent portion of the window sash, as for example is disclosed in the applicant's U.S. Pat. No. 6,109,668, issued Aug. 29, 2000.

Conventional hardware used in the attachment of casement windows in window frames suffers the disadvantage in that it is susceptible to premature corrosion, particularly when used in marine, coastal or other high humidity environments. In particular, conventional window hardware swivel arms, hinge arms and tie bars are typically formed from 3 to 4 mm thick solid steel bars. To delay the effects of corrosion and prolong the window hardware life span, it is known to provide corrosive-resistant zinc platings on the swing and hinge arms, and the tie bar assemblies. It has been found, however, that metal-on-metal contact which occurs with window hardware operation tends to scratch away portions of the protective coating and expose the unprotected underlying steel. This problem is particularly acute at the pivot points and where the tie bars move into contact with the ramped caming members. As a result, the areas of metal-on-metal contact are susceptible to premature corrosion, especially when the hardware is used in such corrosive environments. In addition to initially creating an unsightly appearance, corrosion will ultimately weaken the hinge and locking mechanisms, leading to corrosion embrittlement and fatigue, and ultimately the failure of the window hardware.

While the applicant has considered forming the window hinge arms, swivel arms, and tie bars from solid 2 to 3 mm thick stainless steel stock, so as to prevent corrosion, the increased difficulties in machining and working with such solid stainless steel bars, and the higher costs associated therewith have heretofore made such modifications cost prohibitive.

SUMMARY OF THE INVENTION

To at least partially overcome the disadvantages of prior art window hardware systems, the present invention provides a window closure assembly used to secure a casement window to a window frame, and which includes an elongated rigid closure member useful as a swivel arm, hinge arm and/or tie bar, which is formed by folding a sheet of stainless steel or a stainless steel alloy into two, three or more substantially overlapping layers.

Another object of the invention is to provide hardware used to swingably secure a window sash to a window frame which is highly resistant to corrosive forces so as to prolong its operational life in marine, coastal and other high humidity environments.

Another object of the invention is to provide a window closure member which is suitable for use as a hinge arm, a swivel arm, a tie bar or other window hardware components and which is characterized by multiple juxtaposed stainless steel or other corrosion resistant sheet layers, which are joined together as an elongated rigid multi-layer laminate bar.

Another object of the invention is to provide an elongated bar for use as a window hinge swivel arm, hinge arm or a tie bar which is characterized by at least two juxtaposed metal layers, and which further includes at least one keeper member engaging at least a part of the upper and lowermost metal layers of the bar to assist in maintaining their juxtaposed orientation.

Another object of the invention is to provide an economical and easily fabricated corrosion resistant window closure system characterized by a swivel arm, hinge arm or tie bar for use in securing a window sash to a window frame, and which has an elongated portion formed entirely from multiple layers of stainless steel.

A further object of the invention is to provide a stainless steel or stainless steel alloy window closure member which is lightweight, economical to produce and which possesses substantially the same rigidity and strength as conventional window closure hardware made from solid steel bar stock.

The present invention provides a closure member to be used with a window closure system in securing a window sash to a window frame. The closure member is characterized by a corrosion resistant elongated rigid rectangular portion or body. Preferably, the elongated portion or body of the closure member is characterized by two, three or more stainless steel, stainless steel alloy or other corrosion resistant metal sheet layers provided in a juxtaposed and substantially overlapping orientation. Most preferably, the closure member is formed from folding one or more stainless steel sheets having a thickness selected at between about 0.25 and 2 mm, and more preferably, about 0.25 and 1 mm, and wherein an edge portion of the sheet is bent back against an adjacent portion to form a multi-layered laminate structure.

Although not essential, to provide the closure member with an aesthetically pleasing appearance while eliminating potentially dangerous sharp side edges, opposing longitudinal edge portions of the stainless sheet may be folded inwardly against a central portion of the sheet by bending along two longitudinal extending and parallel fold seams. Optionally, the stainless steel sheet may be bent along substantially folded seams which are spaced inwardly from the edges of the sheet, and most preferably fold seams spaced inwardly from the immediately adjacent edge by a distance which is approximately one-quarter of the total width of the sheet. The folded longitudinal edge portions of the sheet are bent so as to substantially directly overly the middle portion of the sheet bordered by the fold seams. As will be described, when so bent, the stainless steel sheet defines two generally planar juxtaposed metal layers, wherein one layer is a split layer which includes a longitudinally extending seam defined by the repositioned edges of the stainless steel sheet, and which extends longitudinally along a medial portion of the body.

The closure member may be used to secure a window sash to a window as part of a swivel arm, a hinge arm, and/or as part of a reciprocally movable tie bar used to selectively lock or unlock the window sash to the frame. Most preferably, the closure member is further characterized by one or more keeper members which engage the metal layers and prevent their movement from a juxtaposed orientation. Suitable keeper members may include without limitation, a caming or pivot boss which engages one or part of each of the outermost metal layers, to restrict their movement apart, or depending upon the intended application for the window closure member, the keeper member could alternately comprise one or more of a locking stud, a snap stud, a pivot stud, or other suitable pivot fastener. Although not essential, the keeper member is preferably positioned within a bore formed through the body so that once positioned, the keeper member engages the split metal layer on each side of any seam.

Accordingly, in one aspect the present invention resides in a hinge assembly for swingably attaching a window sash to a window frame, comprising, a track assembly attachable to the window frame and including an elongated track, an elongated swivel arm pivotally coupled at a first end portion to the track assembly, and an elongated hinge arm extending from a first end to a second end, the first end being slidable along at least a portion of the track, a second other end portion of said swivel arm being pivotally coupled to the hinge arm at a pivot point intermediate said first and second ends, the improvement wherein at least one of said swivel arm and said hinge arm comprises a closure member characterized by a rigid elongated rectangular body portion formed from a folded metal sheet and having at least two substantially juxtaposed metal layers, and wherein said metal layers are joined along at least one integral and longitudinally extending folded edge.

In another aspect, the present invention resides in a corrosion resistant window closure member for use as window hardware to secure a window sash to a window frame, said closure member comprising an elongated rigid rectangular body portion having substantially parallel longitudinally extending edges, said body portion being formed from a stainless steel sheet and characterized by longitudinally extending folded edges, and two juxtaposed generally planer metal layers joined along each longitudinally extending folded edge.

In a further aspect, the present invention resides in a hinge assembly for swingably attaching a window sash to a window frame, comprising, a track assembly attachable to the window frame and including an elongated track, an elongated swivel arm pivotally coupled at a first end portion to the track assembly, an elongated hinge arm extending from a first end to a second end, the first end being slidable along at least a portion of the track, a second other end portion of said swivel arm being pivotally coupled to the hinge arm at a pivot point intermediate said first and second ends, and the improvement wherein at least one of said swivel arm and said hinge arm includes a closure member characterized by a elongated rectangular body portion comprising a plurality of juxtaposed metal layers being integrally and substantially continuously joined along longitudinally extending edges, and wherein said edges are formed from folding a single sheet of metal.

BRIEF DESCRIPTION OF THE DRAWINGS

Reference may now be had to the accompanying detailed description taken together with the accompanying drawings which.

DETAILED DESCRIPTION OF THE DRAWINGS

Figure 1:
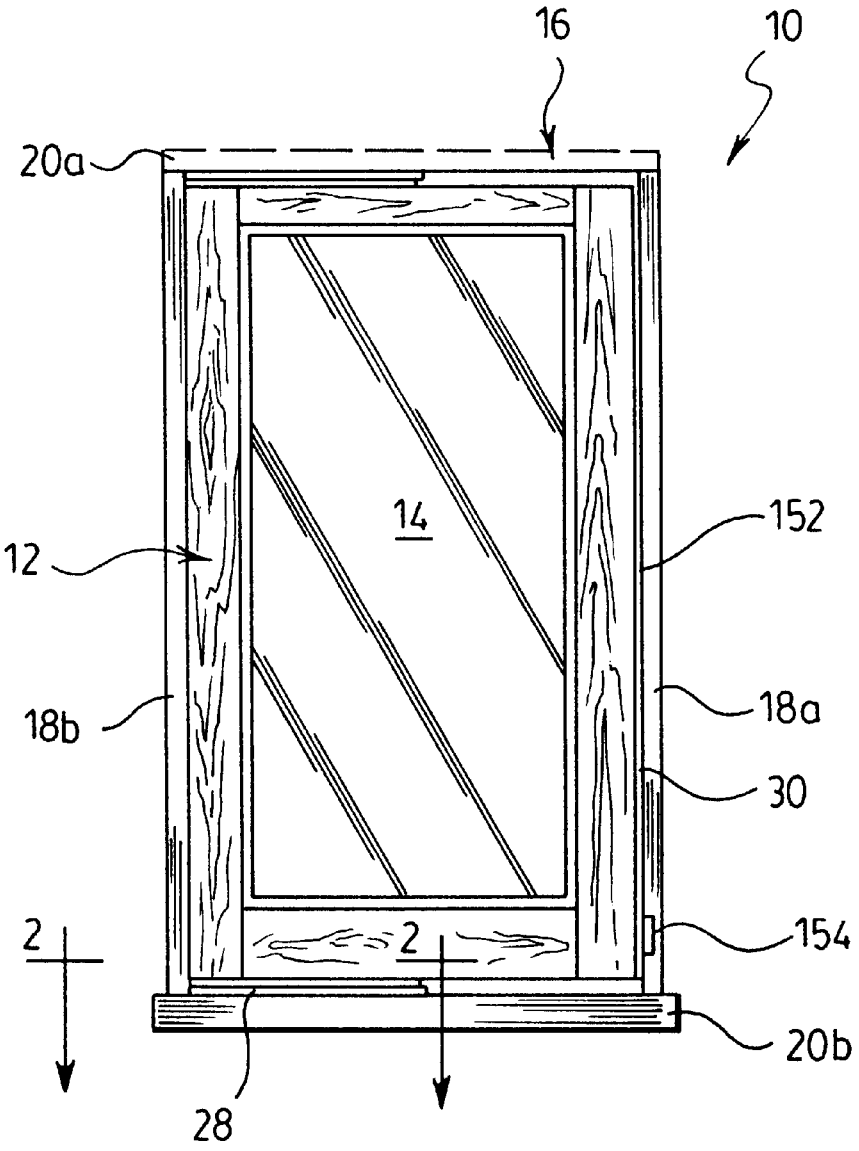
FIG. 1 shows a perspective view of a casement window incorporating the window closure hardware in accordance with the present invention.

Reference is now made to FIG. 1 which illustrates a casement window unit 10 which includes a window which consists of a casement window sash 12 and glass pane 14, and a surrounding window frame 16 which comprises a pair of vertical frame members 18*a*, 18*b* joined at their upper and lower ends by parallel horizontal frame members 20*a*,20*b*. As will be described, the window sash 12 is swingably attached and locked to the window frame 16 by a corrosion resistant window closure system which includes a window track and hinge assembly 28 and a multi-point locking assembly 30.

Figure 2:
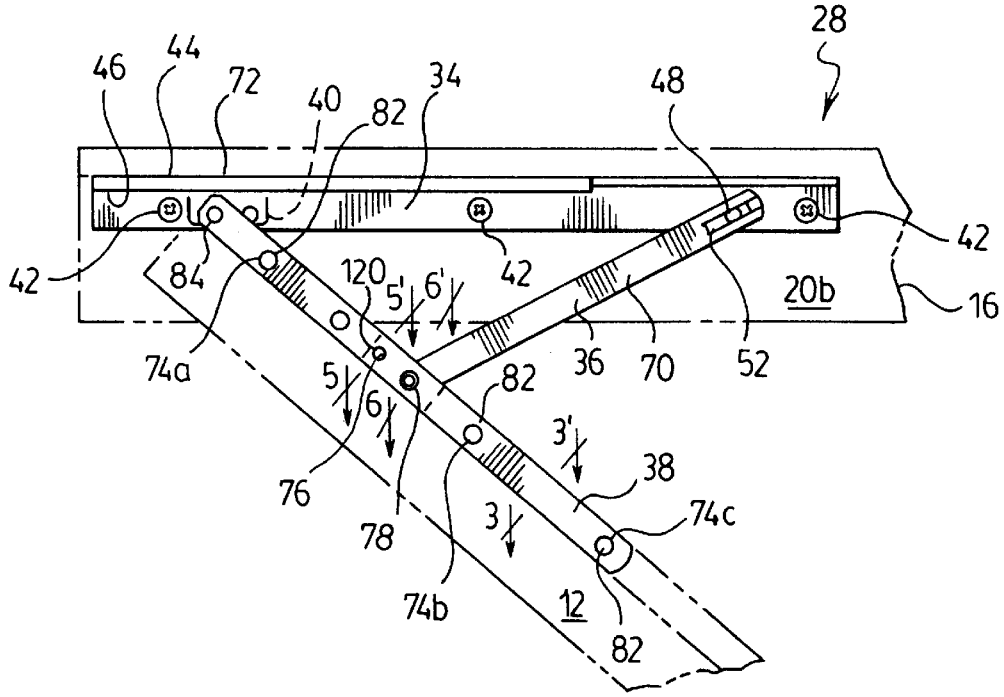
FIG. 2 shows a partial perspective view of the window hinge assembly in accordance with the present invention taken along line 2—2 with the window moved to a partially open position.

FIG. 2 illustrates best the track and hinge assembly 28 as being used to swingably attach the window sash 12 to the window frame 16. The track and hinge assembly 28 comprises an elongated stainless steel track 34, a swivel arm 36, and an elongated hinge arm 38, one end of which is slidable along the track 34 in its direction of 34 elongation by means of a nylon shoe or slider 40. FIG. 2 shows best the track 34 as being secured to the bottom horizontal frame member 20*a* by a series of spaced screws 42. The track 34 further includes an upwardly extending rearward wall 44 which curves forwardly and downwardly along at its uppermost edge to define a downwardly U-shaped open channel 46. As is known, the slider 40 is partially retained in the open channel 46 of the track 34, and has a profile selected to permit its sliding movement longitudinally along the track 34 the length of the channel 46.

FIG. 2 shows best the hinge arm 38 as consisting of a generally elongated stainless steel closure bar 50. The bar 50 has an overall width and length corresponding to that of a conventional solid steel hinge arm and a thickness of between about 1.5 to 3 mm. A series of through bores 72,74*a*,74*b*,74*c*,76,78 are formed through the lateral center of the bar 50. As shown best in FIG. 2, the hinge arm 38 is secured to a lower edge window sash 12 by the insertion of screws 82 through the bores 74*a*,74*b*,74*c*, so as to effect movement of the sash 12 therewith. A first end of the hinge arm 38 is pivotally coupled to the slider 40 for sliding movement along the track 34 by the insertion of a pivot stud 84 through the bore 72 and an aligned bore (not shown) formed through the slider 40.

Figure 3:
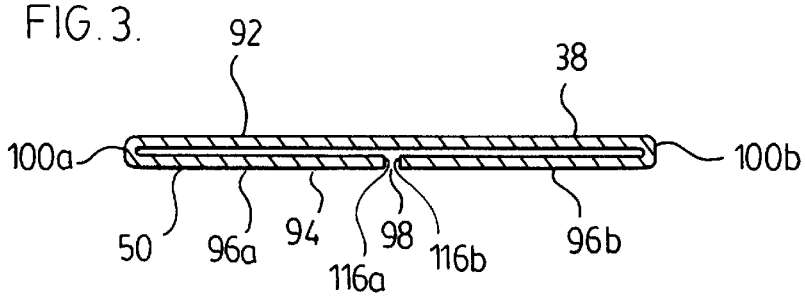
FIG. 3 shows a cross-sectional view of the hinge arm shown in FIG. 2, taken along lines 3–3'.

FIG. 3 shows best a cross-sectional view of the hinge arm closure bar 50 as having two-layer construction consisting of an upper stainless steel layer 92 which directly overlies a lower stainless steel layer 94. The upper stainless steel layer 92 extends continuously across and along the length of the bar 50, so as to shed any moisture which may otherwise collect thereon, and provide the bar 50 with an otherwise solid appearance. The lower stainless steel layer 94 consists of two halves 96*a*,96*b* separated by a seam 98 which extends longitudinally along the underside of the lateral middle of the bar 50. Each half 96*a*,96*b* is integral with the upper stainless steel layer 94 as a single continuous sheet along a respective longitudinal fold edge 100*a*,100*b*.

Figure 4:
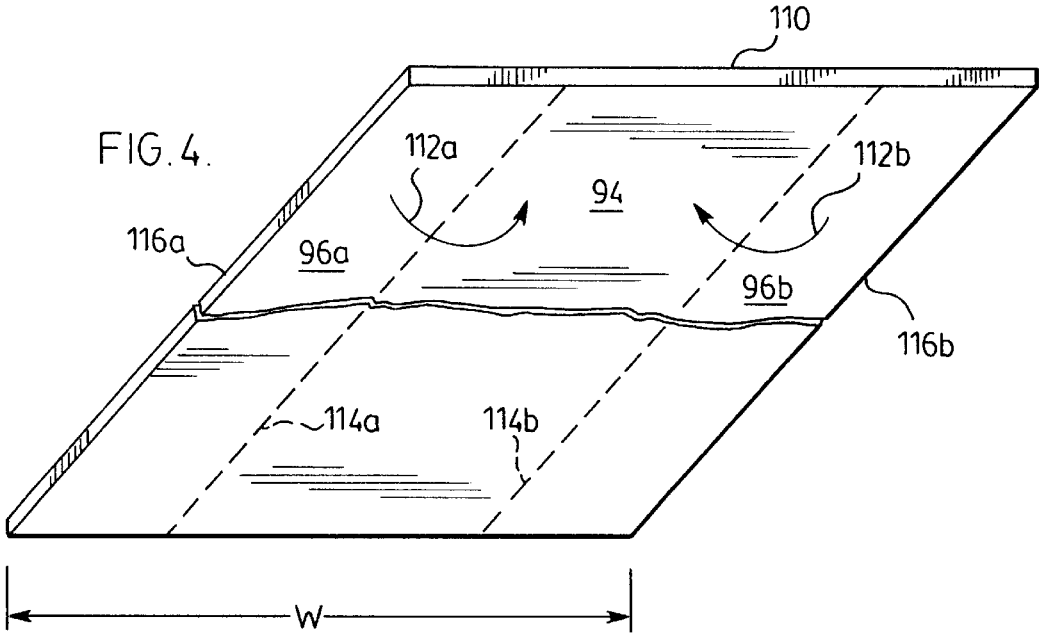
FIG. 4 illustrates an enlarged perspective view of a stainless steel sheet blank used in the manufacture of the closure bar used in the hinge arm assembly of FIG. 3.

FIG. 4 shows best the closure bar 50 as being formed from folding a rectangular stainless steel sheet 110 which has a thickness selected at between about 0.25 and 1 mm. As seen best in FIG. 4, the metal layers 92,94 of the bar 50 are provided in overlying juxtaposition by folding longitudinal edge portions halves (96*a*,96*b*) of the metal sheet 110 in the direction of arrows 112*a*,112*b* along parallel fold seams 114*a*,114*b*, so as to overly the middle portion of the sheet (layer 94). The fold seams 114*a*,114*b* are located a distance inwardly from each respective proximate longitudinal sheet edge 116*a*,116*b*, selected approximately one-quarter of the overall lateral width W of the unfolded sheet 110. The longitudinal edges 116*a*,116*b* of the sheet 110 are moved adjacent to each other so as to define the sides of the longitudinally extending seam line 98, with the seam line extending along the longitudinal center of the bottom metal layer 94 and with the upper 92 and lower layers 94 being integrally joined along each longitudinal edge 100*a*, 100*b*. It is to be appreciated that the formation of the closure bar 50 with integral folded edges 100*a*,100*b* advantageously ensures that the hinge arm 36 is provided with a rounded edge surface which does not present sharp edges which could otherwise cut a user.

Figure 5:
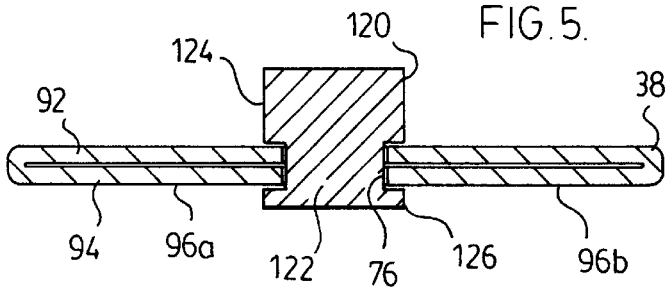
FIG. 5 shows an enlarged cross-sectional view of the hinge arm assembly and stop stud shown in FIG. 2 taken along lines 5–5'.

FIG. 5 further shows the hinge arm 38 as including a stainless steel stop boss 120. The stop boss 120 is secured within the aperture 76 formed through the closure bar 50. As shown, the boss 120 includes a generally cylindrical body portion 122 which has a radial diameter selected to fit snuggly within the aperture 76, and enlarged upper and lower flanges 124,126. As can be seen, the lower flange 124 has a radial dimension selected so as to overly portions of each part 96*a*,96*b* of the bottom metal layer 94 on each side of the seam line (not shown). The upper flange 126 similarly has a radial diameter longer than the bore 76, so as to overly a portion of the upper metal layer 94 adjacent the aperture 76. It is to be appreciated that the flanges 124 and/or 126 may easily be formed by a conventional stamping press or ram. The configuration and radial spread of the stop boss flanges 124,126 effectively sandwich together the portion of the layers 92,94 adjacent the aperture 76, effectively locking the layers 92,94 in juxtaposed contact, and preventing either part 96*a*,96*b* of the lower layer 94 from moving away from the upper layer 92 upon the application of loading stresses to the hinge arm 38.

The swivel arm 36 includes an elongated stainless steel closure bar 70 which has the identical construction as closure bar 50, and wherein like reference numerals are used to identify like components. The arm 36 further includes two through bores or apertures 52,54 (FIG. 6) formed through the middle of the bar 70 towards each of its ends, and wherein aperture 54 has essentially the same diameter as the bore or aperture 78 formed through the closure bar 50. A stainless steel releasable locking stud 48, such as that disclosed in the inventor's U.S. Pat. No. 5,920,959, which issued Jul. 13, 1999, is fixedly secured towards an end of the track 34 remote from the wall 44 and channel 46. The aperture 52 is formed with a diameter marginally greater than the diameter of the snap stud 48, so as to permit the insertion of the snap stud 48 therethrough, to pivotally connect our end of the swivel arm 36 to the track 34.

Although not essential, the pivot connection between the swivel arm 36 and track 34 most preferably permits for minor adjustment in the positioning of the snap stud 48. The adjustment mechanism may for example include an adjustable pivot post or an adjustable sleeve used to engage the snap stud, as for example is disclosed in U.S. Pat. No. 5,152,102 to LaSee which issued Oct. 6, 1992.

Figure 6:
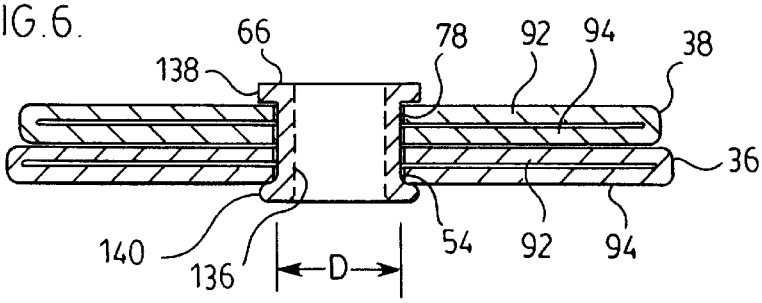
FIG. 6 illustrates an enlarged cross-sectional view of the hinge arm assembly, the swivel arm assembly and the connecting pivot stud shown in FIG. 2 taken along lines 6–6'.

As will be described, the second other end of the swivel arm 36 is pivotally secured to the hinge arm 38 by the insertion of a stainless steel pivot stud 66 through the apertures 54 and 78. More particularly, the swivel arm 36 is pivotally coupled to a mid-portion of the closure bar 70 by aligning the bores 54,78 and thereafter inserting the pivot stud 66 through the aligned openings and crimping it to permanently hingedly couple the swivel arm 36 to the hinge arm 38. FIG. 6 illustrates an enlarged cross-sectional view of the pivot stud 66 used in the hinged coupling of the end of the swivel arm 36 to the medial portion of the hinge arm 38. The pivot stud 66 includes a cylindrical hollow body 136 having a radial diameter D which is selected marginally less than that of the apertures 54 and 78, and one or more crimped ends which define upper and lower radially extending flanges 138,140. In assembly, the aperture 54 of the swivel arm 36 is initially aligned with the aperture 78 of the hinge arm 38. The pivot stud 66 is inserted through the aligned apertures 54,78 and thereafter crimped to form the enlarged upper and lower flanges 138,140. The lower flange 140 of the stud 66 engages the lower metal layer of the swivel arm 36 with the upper flange 138 overlying and engaging the upper metal layer of the hinge arm 38 to hingely couple the arms 36,38 together. As with the stop boss 120, the flanges 138,140 have a radial diameter selected larger than that of the apertures 54,78 so as to overly a portion of the top layer 92 of the hinge arm, and the bottom layer 94 of the swivel arm 36. This construction effectively sandwiches together the layers 92,94 of the hinge arm 38, with the layers 92,94 of the swivel arm 36 to effectively prevent their movement from a juxtaposed orientation.

Figure 7:
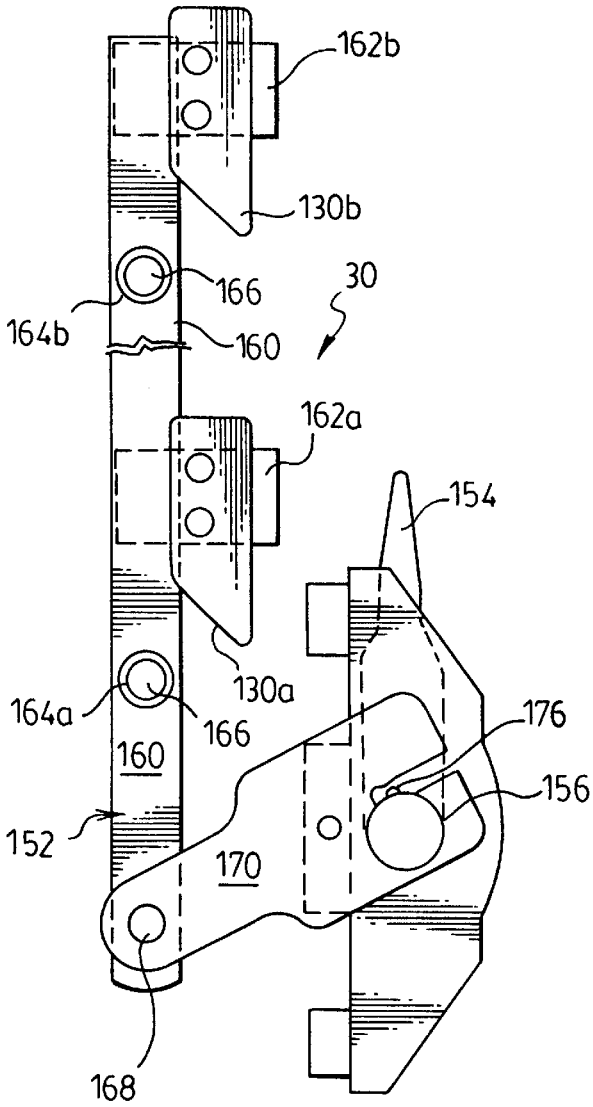
FIG. 7 illustrates schematically a side view of the multi-point locking assembly used to lock the casement window of FIG. 1.

Although FIGS. 1 to 5 illustrate the swivel arm 36 and hinge arm 38 as incorporating stainless steel closure bars 50,70, it is to be appreciated that closure bars having the identical profile to that shown in FIG. 3 may also be used in the manufacture of other components of the window closure system, including the locking assembly 30. FIGS. 7 illustrates best the multi-point locking assembly 30 used to secure or lock the window sash 12 closed against the window frame 16. The locking assembly 30 consists of at least two vertically spaced ramp members 150*a*,150*b* which in assembly are secured to the sash 12, a tie bar assembly 152, and an actuating handle 154 which are mounted to the vertical frame member 18*a* (FIG. 1). As will be described, the actuating handle 154 is reciprocally movable about a pivot 156 to selectively raise or lower the tie bar assembly 152 into and out of engagement with the ramp members 150*a*, 150*b* to lock or unlock the window sash 12.

The tie bar assembly 152 includes a closure or tie bar 160, a pair of vertically spaced mounting brackets 162*a*, 162*b* used to vertically and slidably secure the tie bar 160 to the vertical frame member 18*a* and a pair of nylon caming rollers 164*a*,164*b* each rotatably mounted about a stainless steel bearing stud 166. The tie bar 160 is formed from a folded stainless steel sheet and has a substantially cross-sectional identical profile as that of the closure bars 50,70 as is shown in FIG. 3. The brackets 162*a*,162*b* are preferably also formed from stainless steel so as to minimize the likelihood of corrosion in the event of metal-on-metal contact with the tie bar 160. As shown best in FIG. 7, the lowermost end of the tie bar 160 is coupled to the handle 154 by a linkage arm 170 which is joined to the tie bar 160 at a first end by means of a releasable pivot stud 168, and which is engaged at its second other end by a caming pin 170 mounted to the handle 154.

Figure 8:
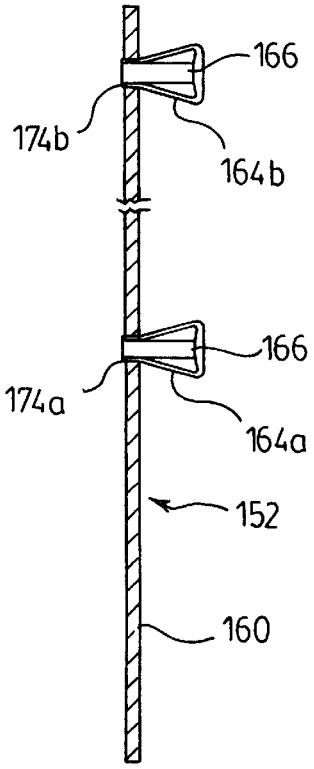
FIG. 8 illustrates a schematic view of the tie bar used in the multi-point locking assembly of FIG. 7.

The bearing studs 166 are inserted through bores 174*a*, 174*b* (FIG. 8) which are formed through the tie bar 160. The bearing studs 166 are thereafter crimped or stamped to provide enlarged upper and lower flanges which overly the adjacent portions of the metal layers which form the tie bar 160 in essentially the identical manner as the upwardly flanges 122,124 which overly the layers 92,94 of the bar 50 shown in FIG. 5.

The movement of the handle 154 effects sliding movement of the tie bar 160 downwardly to achieve unlocking of the window sash 12 whereby the rollers 164*a*,164*b* are lowered out of engagement with the ramp members 150*a*, 150*b*. When the window sash 16 is fully closed, the rotation of the handle 154 downwardly may thus be used to raise the tie bar 160 and return the rollers 164a,164b into engaging contact with the ramp members 150*a*, 150*b* to lock the window sash 12 as the rollers 164*a*, 164*b* are moved thereagainst.

Optionally, the rollers 164*a*, 164*b* may be formed from stainless steel as either a freely rotatable bushing, or integrally formed as part of each stainless steel stud 166.

It is to be appreciated that because of their stainless steel composition, the closure bars 50,70 of the present invention provide enhanced corrosion resistance, making the window hardware particularly suited for use in high humidity applications, such as coastal and marine environments. Furthermore, for increased longevity, more preferably each of the stop studs, bosses 120 and pivots 66 are also formed from stainless steel and/or stainless steel alloys, thereby providing a minimum number of window hardware parts which may otherwise be susceptible to premature corrosion.

By forming the exterior mounted tie bar assembly 152 entirely out of non-corroding materials, the window locking assembly 30 closure hardware will possess increased corrosion resistance and exhibit enhanced life span.

Although the preferred embodiment of the invention illustrates the hinge arm closure bar 50 and tie bar 160 as being manufactured from a stainless steel sheet so as to have two overlapping metal layers 92,94 so that the invention is not so limited. It is to be appreciated that if desired, the tie bar 160 and closure bars 50, 70 could be formed with three, four or more overlapping stainless steel layers as for example by bending a stainless steel sheet into an S pattern or the like. Similarly, in a less preferred embodiment, the closure bars 50,70 and tie bar 160 could be formed simply by laminating a series of separate thin stainless steel sheets, and securing the sheets with rivets or other suitable fasteners.

Alternately in a more simplified construction the closure bars 50, 70 could be formed folding a single metal sheet about only one edge in a flattened C-shape.

Although the detailed description describes and illustrates various preferred embodiments, the invention is not limited. Many modifications and variations will now occur to persons skilled in the art. For a definition of the invention, reference may be had to the appended claims.

We claim:

1. A corrosion resistant window closure member comprising, an elongated rigid rectangular body portion having substantially parallel longitudinally extending edges, said body portion comprising a single, continuous, stainless steel sheet having a first generally planar layer and two juxtaposed generally planar metal members, each of said metal members extending from a respective one of said longitudinally extending edges and being in substantial abutting contact with said planar layer between said edge and an end portion thereof, a bore extending through the planar layer between the metal members, a keeper positioned in the bore and engaging a portion of each of the metal members and substantially preventing the metal members from moving out of abutting contact with the planar layer, the closure member being mounted to one of a window sash and a window frame for selective movement to engage the other of the window sash and window frame for preventing movement of the window sash relative to the window frame.

2. The closure member of claim 1 wherein said closure member comprises group consisting of a hinge arm, a swivel arm and a tie bar.

3. The closure member as claimed in claim 1 wherein said juxtaposed metal members substantially overly said planar layer.

4. The closure member as claimed in claim 3 wherein said juxtaposed metal members being separated by a longitudinally extending seam, and said keeper comprises a boss engaging portions of each said metal members on each side of said seam to assist in maintaining said metal members in substantially abutting contact with said planar layer.

5. The closure member as claimed in claim 1, wherein said stainless steel sheet has a thickness of between about 0.25 mm and about 2 mm.

6. The closure member as claimed in claim 5 wherein said juxtapose metal members substantially overly the planar layer, said metal members being separated by a longitudinally extending seam.

7. The closure member as claimed in claim 6 wherein said keeper engages said portion of each said metal member on each side of said seam to assist in maintaining said metal members in substantially abutting contact with said planar layer, said keeper being selected from the group consisting of a camming boss, a locking stud, a snap stud, a stop boss and a pivot boss.

8. A corrosion resistant window closure member comprising, an elongated generally rectangular body having substantially parallel longitudinally extending edges, the body comprising a single, continuous, steel sheet having a first generally planar layer and two juxtaposed substantially planar metal members, each of said metal members extending from a respective one of said longitudinally extending edges and being in substantial abutting contact with said planar layer between said edge and an end portion thereof, said steel sheet comprising one of a stainless steel and a stainless steel alloy, a bore extending through the planar layer between the metal members, a keeper positioned in the bore and engaging a portion of each of the metal members and substantially preventing the metal members from moving out of abutting contact with the planar layer, the closure member being mounted to one of a window sash and a window frame for selective movement to engage the other of the window sash and window frame for prevention movement of the window sash relative to the window from.

9. The closure member as claimed in claim 8, wherein said juxtaposed metal members being separated by a longitudinally extending seam.

10. The closure member of claim 9 wherein said keeper engages a part of each said metal member on each side of said seam.

11. The closure member of claim 10 wherein said keeper is selected from the group consisting of a caming boss, a locking stud, a snap stud, a stop boss and a pivot stud.

12. The closure member as claimed in claim 8 wherein said steel sheet has a thickness of less than about 1 mm.

13. The closure member as claimed in claim 8 wherein closure member comprises a tie bar.

* * * * *